US006692655B1

(12) United States Patent
Martins et al.

(10) Patent No.: US 6,692,655 B1
(45) Date of Patent: Feb. 17, 2004

(54) METHOD OF MAKING MULTI-BASE PROPELLANTS FROM PELLETIZED NITROCELLULOSE

(75) Inventors: Laura J. Martins, Ogden, UT (US); Richard B. Cragun, Pleasant View, UT (US); Gary K. Lund, Malad, IN (US); Michael V. Wells, Brigham City, UT (US); Vincent E. Mancini, North Ogden, UT (US)

(73) Assignee: Alliant Techsystems Inc., Edina, MN (US)

( * ) Notice: Subject to any disclaimer, the term of this patent is extended or adjusted under 35 U.S.C. 154(b) by 135 days.

(21) Appl. No.: 09/803,236

(22) Filed: Mar. 9, 2001

Related U.S. Application Data

(60) Provisional application No. 60/188,181, filed on Mar. 10, 2000.

(51) Int. Cl.[7] ..... C06B 31/22; C06B 21/00; C06B 45/04; C06B 31/50; F42B 15/00

(52) U.S. Cl. ..... 252/183; 252/500; 252/183; 149/17; 149/18; 149/19; 149/53; 149/60; 149/63; 264/3.4; 264/3.5

(58) Field of Search ..... 149/17, 18, 19.5, 149/19.93, 53, 60, 63; 102/379; 264/3.4, 3.5, 3.6; 252/183.11, 183.12, 183.13, 500

(56) References Cited

U.S. PATENT DOCUMENTS

| | | | | |
|---|---|---|---|---|
| 2,994,597 A | | 8/1961 | Gey | |
| 3,637,444 A | | 1/1972 | Bonyata et al. | |
| 3,682,726 A | | 8/1972 | Stiefel | |
| 3,743,554 A | | 7/1973 | Mellow | |
| 3,798,085 A | | 3/1974 | Mellow | |
| 4,038,115 A | | 7/1977 | Dehm | |
| 4,263,069 A | | 4/1981 | Reed, Jr. et al. | |
| 4,326,901 A | | 4/1982 | Leneveu et al. | |
| 4,354,884 A | | 10/1982 | Williams | |
| 4,724,017 A | | 2/1988 | Eich et al. | |
| 4,909,868 A | | 3/1990 | Melvin | |
| 4,950,342 A | | 8/1990 | Canterberry | |
| 5,372,664 A | * | 12/1994 | Neidert et al. | 149/19.8 |
| 5,468,313 A | * | 11/1995 | Wallace et al. | 149/53 |
| 5,540,794 A | * | 7/1996 | Willer et al. | 149/19.8 |
| 5,767,221 A | | 6/1998 | Poulter et al. | |

OTHER PUBLICATIONS

Solid Rocket Propulsion Technology, pp. 502–505 (Pergamon Press 1993).

* cited by examiner

*Primary Examiner*—Mark Kopec
*Assistant Examiner*—Kallambella Vijayakumar
(74) *Attorney, Agent, or Firm*—TraskBritt

(57) ABSTRACT

In this method for making multi-base propellants, pelletized nitrocellulose is coated with an electrostatically insensitive liquid elastomer precursor or non-plasticizer while wetted in a non-solvent diluent, preferably in the absence of plasticizers. The non-solvent diluent is then substantially, if not completely, removed from the coated nitrocellulose. Then, the coated pelletized nitrocellulose is mixed with a plasticizer and optionally other ingredients and fillers, including energetic fuels such as nitroguanidine. The propellant formulation is then cast, and optionally cured with an acceptable curative, such as a diisocyanate or polyisocyanate. The resulting material may be visually (i.e., to the naked eye) homogeneous. Also, the coated nitrocellulose pellets present during processing have reduced sensitivity to electrostatic discharge.

52 Claims, 1 Drawing Sheet

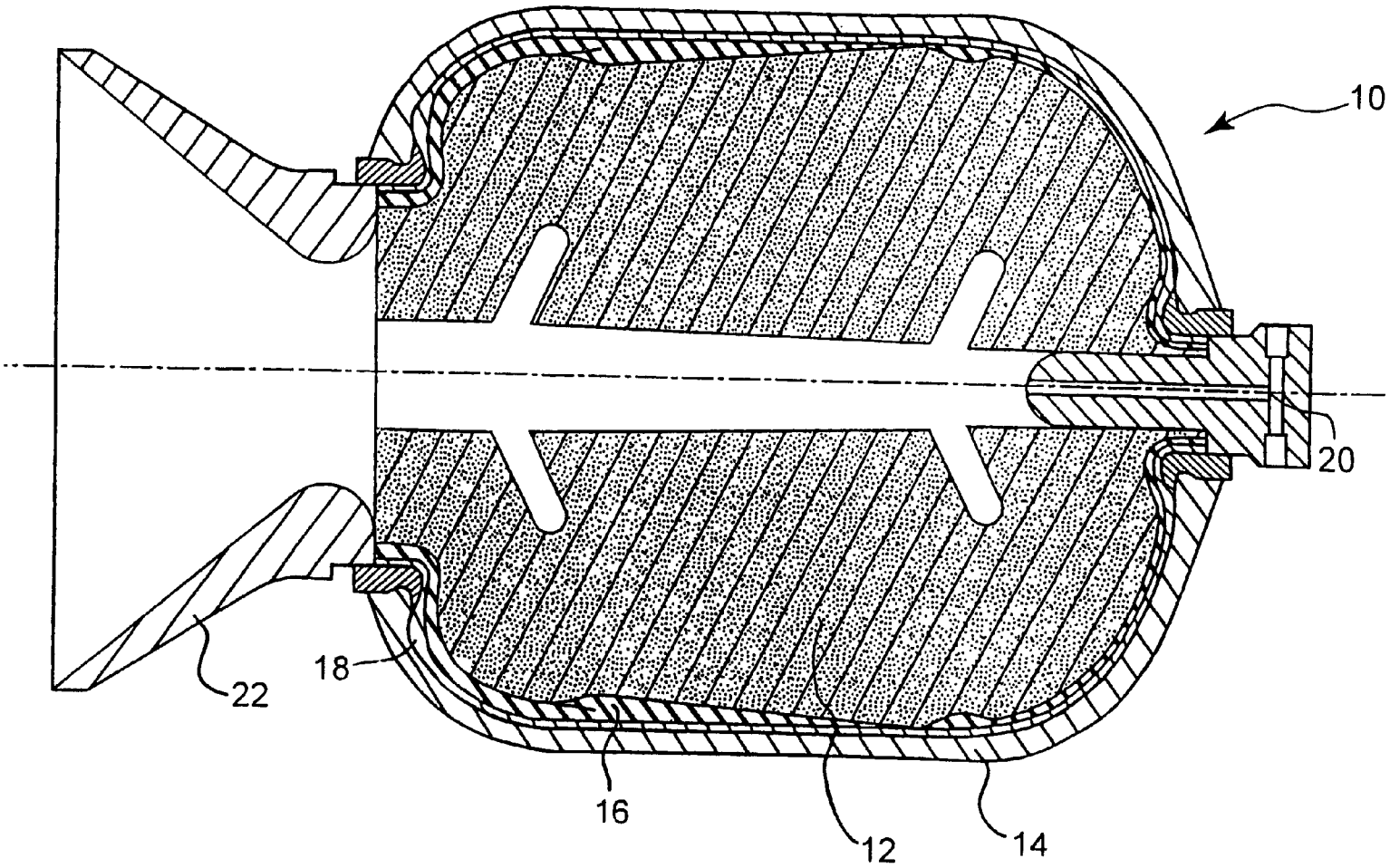
10
20
14
12
16
18
22

METHOD OF MAKING MULTI-BASE PROPELLANTS FROM PELLETIZED NITROCELLULOSE

CROSS-REFERENCE TO RELATED APPLICATION

The benefit of priority is claimed based on U.S. Provisional Application 60/188,181 filed in the U.S. Patent & Trademark Office on Mar. 10, 2000, the complete disclosure of which is incorporated herein by reference.

BACKGROUND OF THE INVENTION

1. Field of the Invention

This invention relates to multi-base propellants, and especially to cross-linked plastisol propellants suited for use in rocket motor assemblies. This invention further relates to rocket motor assemblies loaded with the multi-base propellants.

2. Description of the Related Art

A typical solid fuel rocket motor generally comprises a case of metal or reinforced polymeric composite material and a nozzle attached to the case. Within the case is a propellant grain, which upon firing undergoes combustion reactions to generate large quantities of combustion gases and particles (i.e., combustion products). The combustion products generated by the propellant grain are expelled through the nozzle attached to the case. Nozzles are designed to accelerate the combustion product gases from the propellant grain to the maximum velocity at exit. Most commonly, this design involves a provision in the nozzle pathway comprising a throat having a restricted cross-sectional area, and a frustoconical skirt aft of the throat. The throat and skirt collectively define a converging/diverging configuration to the nozzle pathway. A heat insulating layer and a liner are usually interposed between the grain and the outer case to protect the outer case from the high operating temperatures associated with rocket motor operation and the erosive high velocity particles generated during combustion of the propellant grain. The liner serves the additional function of enhancing grain-to-case or grain-to-insulation bonding.

Propellants containing nitrocellulose as the principle energetic polymeric binder plasticized with one or more plasticizers are commonly referred to in the art as double-base propellants. A typical formulation for a double-base propellant includes, as its main ingredients, 10–90 wt % nitrocellulose and 10–90 wt % plasticizer, more preferably 40–70 wt % nitrocellulose and 30–60 wt % plasticizer. Among the plasticizers most commonly used in the art for forming double-base propellants are nitroglycerine, butanetrioltrinitrate, and diglycol dinitrate.

Another common ingredient used with plasticized nitrocellulose-based propellants is nitroguanidine. Propellants containing nitrocellulose, one or more plasticizers, and nitroguanidine are commonly referred to in the art as a triple-base propellant. (The term triple-base propellant has also sometimes been used to denote propellants containing nitrocellulose, one or more plasticizers, and energetic fuels other than nitroguanidine.) It is common in the art to classify both double-base and triple-base propellants as multi-base propellants.

Another class of propellants is composite-modified multi-base propellants, in which the nitrocellulose serves the additional function of acting as a binder to immobilize oxidizer particles (e.g., ammonium perchlorate) and/or fuel (e.g., aluminum) particles.

It is known in the art to make multi-base propellants from plastisol-grade nitrocellulose. The term "pelletized nitrocellulose" (PNC) propellant refers to multi-base propellants made via a conventional slurry mixing technique in which the pelletized nitrocellulose is processed by slurry mixing and pouring the mixed slurry, in an uncured state, into casting molds or rocket motors in a casting step. The slurry is prepared by dispersing pelletized nitrocellulose having diameters generally on the order of 1 to 20 microns in a suitable non-solvent diluent, most commonly heptane. To the slurry is added a suitable nitrate ester plasticizer, such as nitroglycerin and/or butanetrioltrinitrate (BTTN). Other processing agents and chemical stabilizers, such as N-methyl-p-nitroaniline (MNA), are also added to the slurry at this stage. After removing a portion of the heptane from the top of the formulation, mixing is performed under vacuum conditions to remove remnants of the heptane from the slurry. Next, further ingredients are added and the formulation is mixed in an appropriate mixer, such as a vertical mixer. These ingredients include, among others, fibers, ballistic additives, energetic solid fuels, and, in the case of a composite multi-base propellant, oxidizer particles and/or fuel particles. After thoroughly mixing the formulation, a suitable cross-linker (e.g., a diisocyanate) may be added and the propellant is cast and cured to form a homogenous propellant.

Advantageous properties associated with multi-base propellants include their excellent ambient mechanical properties, low shock sensitivity, excellent ballistics, and operational characteristics, as well as their low signature plumes. These properties make multi-base propellants highly desirable for many rocket motor applications. However, the use of multi-base propellants is not without its problems.

Several hazards and time-consuming steps make the conventional plastisol production process undesirable for large-scale implementation. For example, although the pelletized nitrocellulose is relatively safe to handle when diluted in heptane, without the diluent the dry nitrocellulose is extremely sensitive to electrostatic discharge (ESD), especially prior to admixture of the nitrocellulose with plasticizer. The ESD sensitivity of the nitrocellulose is especially problematic with nitrocellulose in dry pellet form, since the pellets are characterized by a relatively high surface area. During normal handling of heptane-wet pelletized nitrocellulose, the heptane tends to evaporate due to its low boiling point. Evaporation of the heptane from the slurry tends to leave small quantities of hazardous (electrostatic-discharge sensitive) dry nitrocellulose on the surfaces of tooling and bulk container walls. Special precautions must be taken to avoid the deposition of hazardous dry nitrocellulose and, when such precautions are not fully effective and dry nitrocellulose is deposited on the tooling and bulk container walls, to safely remove the dry nitrocellulose without incident. Removal of the heptane diluent from the plasticized slurry during processing is also labor-intensive, time-consuming, and is usually performed at various stages of the conventional process, requiring repeated assaying of heptane concentration. Heptane is a low conductivity, flammable and hazardous solvent, and must be handled with caution.

Additionally, despite the excellent mechanical properties that multi-base propellants possess at ambient temperatures, multi-base propellants have consistently been found to exhibit inferior mechanical properties, such as tensile strength, at extreme low and elevated temperatures. Dramatic temperature changes that a multi-base propellant experiences in normal fabrication and use may generate mechanical strain in the propellant. If the multi-base propellant does not have satisfactory mechanical properties, these mechanical strains may increase the likelihood of fracture to the propellant grain, especially at low temperature ignition. Fractures in a propellant grain can, if widespread, significantly increase the propellant surface area available for combustion reaction. Attempting to anticipate the degree of fracture and the locations at which fractures will occur adds a large degree of uncertainty and unpredictability to motor performance. As a consequence, the chamber pressure created during combustion of a multi-base propellant grain can be increased to unanticipated levels.

SUMMARY OF THE INVENTION

The present invention is directed to a method of making a multi-base propellant by a suitable technique that substantially avoids the hazards and deleterious processing economies associated with the formation of dry nitrocellulose on processing equipment and tooling, yet produces a multi-base propellant that is mechanically robust, even over a wide range of operating temperatures such as −46° C. (−50° F.) to 66° C. (150° F.), which are normally experienced in rocket motor operation.

In accordance with the principles of this invention, a method for making multi-base propellants according to one embodiment of the invention in which pelletized nitrocellulose is coated with an electrostatically insensitive liquid elastomer precursor while wetted in an appropriate non-solvent diluent (e.g., an alkane such as heptane), in the absence of plasticizers, is provided. The non-solvent diluent is then substantially, if not completely, removed from the coated nitrocellulose. Subsequent to removing the diluent, the coated pelletized nitrocellulose is mixed with one or more plasticizers and optionally other ingredients and fillers, including (optionally) energetic fuels such as nitroguanidine for making triple-base propellants. In the event that a composite-modified multi-base propellant is desired, oxidizer particles and fuel particles are also added to and mixed with the coated nitrocellulose. The propellant formulation is then cast, typically into a rocket motor case or a mold of suitable configuration. If a cross-linked multi-base propellant is desired, the cast propellant formulation is then cured with an acceptable curative, such as a diisocyanate or polyisocyanate, which is preferably added with the other optional ingredients and fillers prior to casting. The resulting material is visually (i.e., to the naked eye) homogeneous, insofar as there are no discrete nitrocellulose pellets or particle-like formations remaining in the cured propellant. Also, the coated nitrocellulose pellets present during processing have reduced sensitivity to electrostatic discharge.

Unlike the conventional process in which the pelletized nitrocellulose is not coated during diluent evaporation and can deposit as dry nitrocellulose powder on tooling and bulk container walls, in the novel process of this invention the nitrocellulose is coated with a liquid elastomer precursor prior to removal of the diluent. As a consequence, upon removal of the diluent, any nitrocellulose that deposits on tooling and bulk container walls is coated with a protective coating, which shields the pelletized nitrocellulose from the influences of electrostatic discharges.

The present invention provides a novel method in which most, if not all, of the organic non-solvent (e.g., an alkane such as heptane) can be removed in a single step, such as by heating, prior to adding the plasticizer. As a result, the inventive method avoids the need for repeated diluent removal and assaying steps. The inventors have discovered that by obviating the need for repeated diluent removal and assaying steps, an uncured propellant formulation can be made in accordance with the inventive process in approximately 50% to 80% of the amount of time needed to practice the conventional method. Substantial savings in operating costs and time and manpower can be realized by this reduction in processing time.

The present invention further provides a method of making a cured multi-base propellant, especially a minimum smoke Class 1.3 propellant, that contains a dispersed elastomer and is visually homogenous, insofar as no discrete nitrocellulose pellets or particle-like remnants remain in the propellant subsequent to curing. This may be achieved by practicing the method described above, although the visually homogeneous cured multi-base propellant described herein is not limited to propellants made by this embodiment.

Still further, the present invention provides a method for making multi-base propellants in which pelletized nitrocellulose is coated with an electrostatically insensitive liquid non-plasticizer while wetted in an appropriate non-solvent diluent (e.g., an alkane such as heptane), in the absence of plasticizers. As referred to in the context of this embodiment of the invention and as understood in the art, non-plasticizer means a liquid that does not swell the nitrocellulose, and is not meant to encompass the elastomer precursors described above. Representative non-plasticizers include n-alkyl citrate (e.g., CITROFLEX), diethyl suberate, diethyl sebacate, di-n-propyl adipate, IDP (isodecylperlargonate), and combinations thereof. Other non-plasticizers that are believed to be suitable include, by way of example, DOA (dioctyladipate), DOP (dioctylphthalate), DOM (dioctylmaleate), DBP (dibutylphthalate), diethylphthalate, dipropylphthalate, diethyl pimelate, and combinations thereof. The non-solvent diluent is then substantially, if not completely, removed from the non-plasticizer-coated nitrocellouse. Subsequent to removing the diluent, the coated pelletized nitrocellulose is mixed with one or more plasticizers and optionally other ingredients and fillers, including (optionally) energetic fuels such as nitroguanidine for making triple-base propellants. In the event that a composite-modified multi-base propellant is desired, oxidizer particles and fuel particles are also added to and mixed with the coated nitrocellulose. The propellant formulation is then cast, typically into a rocket motor case or a mold of suitable configuration. If a cross-linked multi-base propellant is desired, the cast propellant formulation is then cured with an acceptable curative, such as a diisocyanate or polyisocyanate, which is preferably added with the other optional ingredients and fillers prior to casting. Although not wishing to be bound by any theory, it is believed that the isocyanate moieties of the curative react with the hydroxide groups of the nitrocellulose. The resulting material may be visually (i.e., to the naked eye) homogeneous, insofar as there are no discrete nitrocellulose pellets or particle-like formations remaining in the cured propellant. Also, the coated nitrocellulose pellets present during processing have reduced sensitivity to electrostatic discharge.

This invention is also directed to coated nitrocellulose pellets, rocket motor assembles comprising solid multi-base propellants derived from the coated nitrocellulose pellets, and to a method of making the rocket motor assemblies.

These and other objects, features, and advantages of this invention will be apparent to those skilled in the art upon reading the specification, when taken in conjunction with the accompanying drawing, which plain the principles of this invention.

BRIEF DESCRIPTION OF THE DRAWING

The accompanying drawing is incorporated in and constitutes a part of the specification. The drawing, together with the general description given above and the detailed description of the preferred embodiments and methods given below, serve to explain the principles of the invention. In such drawing, there is shown an embodiment of a rocket motor assembly in which the propellant made by the method of this invention may be used.

DETAILED DESCRIPTION OF THE INVENTION

One of the ingredients of the inventive method is pelletized nitrocellulose (also referred to as plastisol nitrocellulose), which is available from various commercial sources, including the U.S. Department of the Navy, at Indian Head, under procurement number 1376-01-149-8877. As referred to herein, pelletized nitrocellulose includes nitrocellulose configured as pellets, as well as nitrocellulose having other configurations, including but not limited to granular and/or particle-like (spherical) configurations. Generally, nitrocellulose pellets especially suited for use herein have diameters of from about 1 micron to about 50 microns, more preferably from about 1 micron to about 30 microns, more preferably from about 1 micron to about 20 microns.

The pelletized nitrocellulose is diluted in an appropriate non-solvent to form a slurry. As the term is used herein, non-solvent refers to the relationship of the non-solvent to the nitrocellulose, and means that the nitrocellulose is either insoluble in the non-solvent or that a sufficiently small portion of the nitrocellulose is dissolved in the non-solvent to form a slurry of nitrocellulose pellets dispersed in the non-solvent. The non-solvent preferably is organic, and has a sufficiently low boiling point and heat of vaporization so that evaporation commences at room temperature (e.g., 27° C. (80° F.)) or slightly above room temperature, yet has a sufficiently high boiling point so as not to completely volatilize at room temperature during processing. Representative non-solvents can be selected from the following groups: straight-chain, branched, and/or alicyclic alkanes, especially those having from five to ten carbon atoms, such as hexane, heptane, octane cyclohexane, and cycloheptane; straight chain, branched, and/or cyclic alkenes and dienes, such as cyclohexene and 1 -heptene; aryls such as benzene and toluene; and low molecular weight alcohols, such as isopropanol, ethanol, and methanol. Certain halogenated organic compounds can also be used, such as chloroform, methylene chloride, and trichloroethane. However, halogenated organic compounds are less preferred as the diluent of choice for this invention, due to their adverse environmental impact and government regulations controlling the use of halogenated organic compounds. Generally, the weight percent of non-solvent, prior to removal of the non-solvent, is preferably maintained from about 10% to about 30%. Preferably, the slurry is free of water throughout the process, and especially prior to coating of the nitrocellulose with an elastomer precursor, since water is relatively difficult to separate from the nitrocellulose. Also, during cure, water can react with certain curatives, especially diisocyanate and polyisocyanate curatives, to thereby interfere with and reduce cross-linking.

To the slurry is added a liquid elastomer precursor having electrostatically insensitive properties. The precursor polymer preferably also improves the mechanical properties of the propellant formulation at low and high temperatures, and has isocyanate-reactive groups (e.g., hydroxyl, carboxyl, and/or thiol groups) for promoting curing of the material. A sufficient amount of liquid elastomer precursor should be added so that upon mixing of the slurry with the liquid elastomer precursor, the liquid elastomer precursor is able to coat all of the pelletized nitrocellulose to form discrete coated nitrocellulose pellets. Suitable weight ratios of pelletized nitrocellulose to liquid elastomer precursor range from 4:1 to 19:1, preferably from 4:1 to 9:1.

Representative electrostatically insensitive elastomer precursors include hydroxy-terminated polymers and carboxy-terminated polymers. Examples of hydroxy-terminated polymers suitable for use with the present invention include one or more of the following: polyethers, such as polyethylene glycol (PEG), polypropylene glycol (PPG), polytetramethylene oxide (PTMEG), polyglycidyl nitrate (PGN), and glycidyl azide polymer (GAP); polycaprolactone (PCP); polyglycoladipate (PGA); and random or block copolymers of the above, such as Poly-G® (a random copolymer of polyethylene glycol and polypropylene glycol, made by Olin Corporation). In addition, or as an alternative to the above-mentioned hydroxyl-terminated polymers and carboxy-terminated polymers, other elastomer precursors can be used, such as acrylic acid acrylonitrile polymer, butadiene terpolymer (PBAN), and/or succinic acid triethylene glycol polymer (WITCO brand polymers).

The elastomer precursor is preferably in a liquid state at the time of addition. Thus, if the elastomer precursor forms a liquid at room temperature, the elastomer precursor can be added to the slurry without heating to elevated processing temperatures. On the other hand, in the event that the elastomer precursor forms a solid at room temperature, the elastomer precursor can be heated and melted prior to its addition to the slurry. For example, PCP and PEG (e.g., E-4500) are solid at room temperature, and preferably are processed at elevated temperatures of at least about 60° C. (140° F.) to melt the elastomer precursor prior to their addition to the slurry.

It is also currently preferred to add a thermal stabilizer, such as N-methyl-p-nitroaniline (MNA), to the slurry prior to drying. It has been found that MNA substantially improves the ESD dissipative properties of the dry, coated nitrocellulose pellets and facilitates safe use and handling of the material. Other thermal stabilizers that may be used include ethylcentralite (sym-diethyldiphenylurea), diphenylamine, 2-nitrodiphenyl amine (2NDPA), N-ethyl-p-nitroaniline (NENA), and/or resorcinol. Generally, the thermal stabilizer may constitute from 0.5 weight percent to 10 weight percent, more preferably 4 weight percent, of the total weight of the thermal stabilizer, nitrocellulose, and coating agent.

Coating of the nitrocellulose pellets can be conducted in a suitable mixing apparatus, such as, by way of example, a vertical mixer, a horizontal mixer, a sigina-blade mixer, a ribbon blender, a rotary cone blender/dryer, a V-shell blender, a fluidized bed dryer, roll coating machinery, a slurry reactor, a high shear mixer, or an extruder, such as a twin-screw extruder. For elastomer precursors that are liquid at room temperature, the mixing is preferably conducted at about room temperature or higher to prevent premature evaporation of the non-solvent. Higher mixing temperatures can be used for elastomer precursors such as PCP and PEG, which are solids at room temperature.

Next, all, or at least substantially all, of the non-solvent is removed from the slurry of coated nitrocellulose pellets. As referred to herein, substantially all means that subsequent to removal of the non-solvent from the slurry, the resulting material contains not more than 5 wt % of the non-solvent. It is preferred that not more than 1 wt % of the non-solvent remain. The non-solvent can be removed by heating the material to a temperature sufficiently high to evaporate the non-solvent and/or by applying a vacuum. For example, in the event that heptane is used as the non-solvent, heating may be performed at a temperature above room temperature, up to about 82° C. (180° F.), more preferably up to 66° C. (150° F.), although lower temperatures in this range are preferred. A cold trap can also be used in conjunction with the vacuum to remove the non-solvent. In order to improve process efficiencies, the non-solvent can be recycled.

Although this detailed description has until now discussed the use of a liquid elastomer for coating, it is to be understood that suitable coating materials other than elastomer precursors, such as liquid non-plasticizers, may be used.

Subsequent to removal of all or substantially all of the non-solvent, one or more plasticizers are added to the coated nitrocellulose pellets. Preferably, no plasticizers are added to the propellant formulation until after the non-solvent has been removed from the propellant formulation, since plasticizers interfere with the ability of the elastomer to coat the nitrocellulose pellets and may cause swelling of the nitrocellulose. Generally, if not more than about 5 wt % non-solvent remains, the plasticizer can be added to the coated nitrocellulose pellets without significantly increasing processing time.

Representative energetic plasticizers that are suitable for use with this invention include, by way of example, NG (nitroglycerine), TMETN (trimethylolethanetrinitrate), TEGDN (triethyleneglycoldinitrate), DEGDN (diethyleneglycol-dinitrate), PGDN (polypropyleneglycol dinitrate), EGDN (ethyleneglycol dinitrate), BTTN (butanetrioltrinitrate), alkyl NENA's (such as butyl-2-nitratoethyl-nitramine, methyl-2-nitratoethyl-nitramine, and ethyl-2-nitratoethyl-nitramine), or mixtures thereof. Optionally, the propellant formulation can also include one or more inert liquids in addition to the energetic plasticizer. Representative inert liquids include triacetin (glycerol triacetate; $C_9H_{14}O_6$) plasticizer, DOA (dioctyladipate), IDP (isodecylperlargonate), DOP (dioctylphthalate), DOM (dioctylmaleate), DBP (dibutylphthalate), di-n-propyl adipate, diethylphthalate, dipropylphthalate, n-alkyl citrate (CITROFLEX), diethyl suberate, diethyl sebacate, diethyl pimelate, or mixtures thereof. Generally, the weight ratio of total plasticizer to total polymer (PL/PO) is from 0.5 to 3.5, more preferably about 1.7 to 3.0 for the best mechanical properties (in which the total polymer (PO) means the total weight of nitrocellulose, elastomer precursor coating, and curative).

The propellant formulation preferably also includes additional ingredients for improving the ballistic and mechanical properties of the propellant. As with the case of the plasticizers, these additional ingredients (discussed below) are most preferably added to the formulation after removal of the non-solvent from the coated nitrocellulose, although it is not outside the scope of this invention to add one or more of these additional ingredients prior to removal of the non-solvent. The additional ingredients can also be mixed into the formulation with the aid of a mixing apparatus, which may be the same as or different from the apparatus used to coat the nitrocellulose pellets. Again, suitable mixing apparatuses for incorporating and homogeneously mixing these additional ingredients into the formulation include a vertical mixer, a sigma-blade mixer, and others, such as high shear mixers and extruders such as twin-screw extruders.

Among the additional ingredients that can be added at this stage in the process are thermal stabilizers and ballistic modifiers. Representative thermal stabilizers include, by way of example, N-methyl-p-nitroaniline (MNA), ethylcentralite (sym-diethyldiphenylurea), diphenylamine, 2-nitrodiphenyl amine (2NDPA), N-ethyl-p-nitroaniline (NENA), and/or resorcinol. These thermal stabilizers are generally added in a range of from 0.5% by weight to 3% by weight, more preferably 0.5% by weight to 2% by weight, based on the total weight of the cured propellant. Representative ballistic modifiers include compounds containing lead, bismuth, copper, and/or tin, especially salts, chelates, and oxides. Representative anions for the chelates and salts include citrates, nitrates, stannates, oxalates, sebacates and/or stearates. The ballistic modifier can also be a complex of beta-resorcylate, salicylate, phthlate, 4-acetoamidosalicylate, phenyl, and/or 2-acetoamidobenzoate. These ballistic modifiers can be present in the multi-base propellants in concentrations in a range of from about 0.5% by weight to about 5% by weight, more preferably about 0.5% to about 2% by weight, based on the total weight of the cured propellant.

The propellant formulation of this invention may also comprise graphite and/or high surface area carbon black, wherein high surface area refers to carbon black with a surface area that is preferably greater than or equal to about 25 $m^2/g$. Also, preferably, the weight ratio of the carbon black to the bum rate modifier is in a range of from 1:4 to 2:1, most preferably at a ratio of 1:3.

Another additive suitable for use with this propellant is a coolant, representatives of which include tetrazoles, triazoles, furazans, oxamide, melamine, hexamine, ammonium oxalate, and/or ammonium formate.

In the event that a triple-base propellant is desired, energetic solids that can be used in combination with the nitrocellulose and plasticizer(s) include, by way of example, NQ (nitroguanidine); nitramines, such as TEX (4,10-dinitro-2,6,8,12-tetraoxa-4,10-diazatetracyclo-[5.5.5.0.$0^{5,9}0^{3,11}$]-dodecane), RDX (1,3,5-trinitro-1,3,5-triaza-cyclohexane), HMX (1,3,5,7tetranitro-1,3,5,7-tetraaza-cycloocatane), and HNIW or CL-20 (2,4,6,8,10,12-hexanitro-2,4,6,8,10,12-hexaazatetracyclo[5.5 .0.$0^{5,9}0^{3,11}$]dodecane); NTO (3-nitro-1,2,4-triazol-5-one); TATB (1,3,5-triamino-2,4,6-trinitrobenzene); DADNE (1,1-diamino-2,2-dinitro ethane); AND (ammonium dinitramide); and TNAZ (1,3,3-trinitroazetidine). Generally, the energetic solid organic fuels constitute from about 10% by weight to about 60% by weight of the total weight of the cured propellant.

Where a composite-modified multi-base propellant is desired, oxidizer particles and inorganic fuel particles can also be added. Representative oxidizers include AP (ammonium perchlorate), AN (ammonium nitrate), HAN (hydroxylammonium nitrate), AND (ammonium dinitramide), KDN (potassium dinitramide), KP (potassium perchlorate), or mixtures thereof. Organic oxidizers can also be used. Representative fuels include aluminum, magnesium, boron, titanium, silicon, and alloys and/or mixtures thereof. The metals and oxidizer may be present as a powder, particles, and/or in other forms. Generally, the oxidizer may comprise up to about 50% by weight, or as high as 70% by weight, of the total weight of the cured propellant, whereas the metal fuel, if present, may comprise up to about 20% by weight of the total weight of the cured propellant, although the amount of oxidizer may increase if higher loads of metal fuels are used.

Also, optionally added prior to casting is at least one curative, and optionally one or more cure catalysts. Exemplary curatives include diisocyanates and polyisocyanates. An especially effective curative is biuret triisocyanate Desmodour curative (N-100; $C_{23}H_{38}N_6O_5$). Suitable diisocyanates include hexamethylene diisocyanate (HDI), toluene diisocyanate (TDI), isophorone diisocyanate (IPDI), and dimer diisocyanate (DDI). Exemplary cure catalysts are Lewis acids. Examples include triphenylbismuth, alkyltin compounds, including triphenyltinchloride and dialkyltin carboxylates, such as dibutyl tin dilaurate and dibutyl tin diacetate. Casting and curing techniques are well known in the art, and can be adapted for use with the propellant formulation of this invention without undue experimentation with reference to this disclosure.

Once cured into a cross-linked propellant, the propellant is homogeneous and free of any discrete nitrocellulose pellets that are detectable to the naked eye. Although this invention is not intended to be bound to the following theory, it is believed that the coated pelletized nitrocellulose loses its pellet-like configuration upon addition of the plasticizer. By the time the propellant formulation has been cast and cross-linked into its final propellant form, the nitrocellulose pellets have been sufficiently dispersed and solvated in the plasticizer(s) that the original pellet configurations are not visually detectable to the naked eye.

An example of a rocket motor assembly suitable for use with the present invention is shown in FIG. 1. The assembly 10 includes a cured propellant 12 loaded within the interior surface of the rocket motor case 14. Typically, insulation 16 and a liner 18 are interposed between the case 14 and the propellant 10. The insulation 16 and liner 18 serve to protect the case from the extreme conditions produced by the burning propellant 12. Methods for loading a rocket motor case 14 with an insulation 16, liner 18, and propellant 12 are known to those skilled in the art, and can be readily adapted without undue experimentation to incorporate the propellant of this invention. Liner compositions and methods for applying liners into a rocket motor case are also well known in the art, as exemplified by U.S. Pat. No. 5,767,221. Also shown in FIG. 1 is an igniter 20 attached to the forward end of the case 14 and a nozzle assembly 22 attached at the aft end of the case 14.

The following examples are offered to further illustrate the synthesis methods of the present invention. The examples are intended to be exemplary and should not be viewed as exhaustive of the scope of the invention.

EXAMPLES

Example 1

To a slurry having 163.7 grams of pelletized nitrocellulose and 50.3 grams of heptane was added 18.2 grams of POLY-G® (Olin Corporation) in a twin-blade vertical mixer having a bowl temperature of about 41° C. (106° F.). This material was mixed at a slow mixing speed setting while under vacuum, which was applied at a level of 1 mmHg. After three hours of mixing, a small sample was removed and analyzed for volatiles. This assay revealed that all of the heptane was removed (and captured by a cold finger). The coated particles were mixed under vacuum with 370.1 grams of BTTN, 30 grams of triacetin, 7.2 grams of MNA, 4.5 grams of a bismuth compound, 1.5 grams of carbon black, and 3 grams of fibers to form a mixture. After 1.5 hours of mixing, NI 00 curative was added, and mixing was continued under vacuum for 0.5 hour. The resulting material was a thin, black liquid, which was cast into a 2.54 cm×10.16 cm (1 inch×4 inch) carton and cured for 10 days at 63° C. (145° F.). The cured propellant was a black rubbery solid with a homogeneous appearance.

Examples 2–14

An aliquot of PNC in heptane (75% by weight PNC) was placed into a vertical mixer and a non-conductive coating (POLY-G manufactured by Olin Corporation, CITROFLEX A-4, or IDP) was added to the vertical bowl. In Examples 10–14, isopropanol was added in a weight ratio of 50:50 isopropanol to heptane. The jacket temperature was raised to 100 F. to 130° F. and the internal atmosphere was reduced to 0.75 inches of mercury. The non-solvent, heptane (and optionally isopropanol), was removed over the course of 2 to 4 hours. Then, the pressure was let and the additive(s), if any, was added to the mixture. The materials were then mixed for an additional 15 minutes at atmospheric conditions.

| Example | Coating | Weight percent coating | Additive(s) | Unconfined ESD |
|---|---|---|---|---|
| 2 | POLY-G | 10.00 | — | 0.16 |
| 3 | POLY-G | 5.00 | — | 0.24 |
| 4 | CITROFLEX A-4 | 5.00 | — | 0.35 |
| 5 | POLY-G | 4.90 | 1 wt % of 20 to 40 μm graphite | 0.64 |
| 6 | POLY-G | 4.98 | 0.95 wt % of 1 to 2 μm graphite | 0.34 |
| 7 | CITROFLEX A-4 | 5.00 | 1.0 wt % of 1 to 2 μm graphite | 0.65 |
| 8 | CITROFLEX A-4 | 5.00 | 1.0 wt % of 40 to 60 μm graphite | 0.55 |
| 9 | CITROFLEX A-4 | 4.50 | 0.75 wt % of 1 to 2 μm graphite and 0.75 wt % of 20 to 40 μm graphite | 0.53 |
| 10 | POLY-G | 4.81 | 3.83 wt % MNA | 0.53 |
| 11 | CITROFLEX A-4 | 4.81 | 3.83 wt % MNA | 0.83 |
| 12 | CITROFLEX A-4 | 4.77 | 3.83 wt % MNA and 0.79 wt % of fumed carbon black | 0.76 |
| 13 | CITROFLEX A-4 | 4.82 | 3.83 wt % MNA and 1.0 wt % of 1 to 2 μm graphite | 0.33 |
| 14 | IDP | 5.00 | | 0.50 |

| Property | Dry PNC | Example 3 | Example 10 | Example 11 |
|---|---|---|---|---|
| Material Resistivity (W cm) | $2.34 \times 10^{16}$ | $1.54 \times 10^{13}$ | $8.90 \times 10^{11}$ | $4.92 \times 10^{11}$ |
| Charge Decay Times (sec) | >180 | 18.5 | 3.6 | 3.0 |
| Charge Generation (handling operation peak values (C/g) | $-1.15 \times 10^{-9}$ | $1.49 \times 10^{-9}$ | $7.94 \times 10^{-10}$ | — |
| Charge Generation (mass dump peak values) (C/g) | $-2.42 \times 10^{-9}$ | $2.59 \times 10^{-9}$ | $1.47 \times 10^{-9}$ | — |

These experiments showed that the addition of graphite and/or MNA to the polymer coated PNC reduces the associated ESD hazards of dry coated PNC to safe handling levels. It was also found that the addition of isopropyl alcohol to a PNC/heptane mixture, such as at a 50:50 weight ratio isopropyl alcohol to heptane, aids in the dispersion of the polymer coating and reduces ESD hazards.

The foregoing detailed description of the invention has been provided for the purpose of explaining the principles of the invention and its practical application, thereby enabling others skilled in the art to understand the invention for various embodiments and with various modifications as are suited to the particular use contemplated. The foregoing detailed description is not intended to be exhaustive or to limit the invention to the precise embodiments disclosed. Modifications and equivalents will be apparent to practitioners skilled in this art and are encompassed within the spirit and scope of the appended claims.

What is claimed is:

1. A method of making a multi-base rocket motor propellant, comprising:

diluting nitrocellulose pellets in at least one organic non-solvent to form a slurry;

coating the nitrocellulose pellets with at least one elastomer precursor polymer to form coated nitrocellulose pellets in the slurry, wherein the at least one elastomer precursor polymer is a liquid at room temperature;

removing substantially all of the at least one organic non-solvent from the slurry, wherein the slurry is maintained substantially free of plasticizer prior to removing substantially all of the at least one organic non-solvent therefrom;

subsequent to removing substantially all of the at least one organic non-solvent from the slurry, mixing the coated nitrocellulose pellets with at least one plasticizer to form a propellant formulation; and casting the propellant formulation to form a cast propellant formulation.

2. The method of claim 1, further comprising curing the cast propellant formulation with at least one curative to cure the at least one elastomer precursor polymer into an elastomer, the at least one curative comprising at least one member selected from the group consisting of a diisocyanate and a polyisocyanate.

3. The method of claim 2, wherein diluting nitrocellulose pellets in at least one organic non-solvent to form a slurry comprises diluting nitrocellulose pellets having diameters in a range of from 1 micron to 50 microns.

4. The method of claim 2, wherein diluting nitrocellulose pellets in at least one organic non-solvent to form a slurry comprises diluting nitrocellulose pellets in heptane.

5. The method of claim 2, further comprising maintaining the slurry substantially free of water.

6. The method of claim 2, wherein coating the nitrocellulose pellets with least one elastomer precursor polymer comprises coating the nitrocellulose pellets with at least one member selected from the group consisting of polycaprolactone, a random copolymer of polyethylene glycol and polypropylene glycol, polyethylene glycol, polypropylene glycol, polyglycoladipate, polyglycidyl nitrate, polypropyleneglycol dinitrate, ethyleneglycol dinitrate, and glycidyl azide polymer.

7. The method of claim 2, wherein mixing the coated nitrocellulose pellets with at least one plasticizer comprises mixing the coated nitrocellulose pellets with at least one member selected from the group consisting of nitroglycerine, trimethylolethanetrinitrate, triethyleneglycoldinitrate, diethyleneglycol-dinitrate, butanetrioltrinitrate, alkyl nitratoethylnitramines, and copolymers and combinations thereof.

8. The method of claim 2, further comprising adding at least one thermal stabilizer to the slurry.

9. The method of claim 8, wherein adding at least one thermal stabilizer to the slurry comprises adding at least one member selected from the group consisting of N-methyl-p-nitroaniline, ethylcentralite, diphenylamine, 2-nitrodiphenyl amine, N-ethyl-p-nitroaniline, and resorcinol.

10. The method of claim 1, further comprising adding at least one energetic fuel to the propellant formulation to produce a triple-base propellant.

11. The method of claim 10, wherein adding at least one energetic fuel to the propellant formulation comprises adding at least one energetic fuel selected from the group consisting of nitroguanidine, 4,10-dinitro-2,6,8,12-tetraoxa-4,10-diazatetracyclo-[5.5.0.0$^{5,9}$0$^{3,11}$]-dodecane, 1,3,5-trinitro-1,3,5-triaza-cyclohexane, 1,3,5,7-tetranitro-1,3,5,7-tetraaza-cycloocatane, 2,4,6,8,10,12-hexanitro-2,4,6,8,10,12-hexaazatetracyclo-[5.5.0.0$^{5,9}$0$^{3,11}$]-dodecane, 3-nitro-1,2,4-triazol-5-one, 1,3,5-triamino-2,4,6-trinitrobenzene, 1,1-diamino-2,2-dinitro ethane, ammonium dinitramide, and 1,3,3-trinitroazetidine.

12. The method of claim 1, further comprising adding at least one oxidizer and at least one inorganic fuel to produce a composite-modified multi-base propellant.

13. The method of claim 12, wherein adding at least one oxidizer comprises adding at least one member selected from the group consisting of ammonium perchlorate, ammonium nitrate, hydroxylammonium nitrate, ammonium dinitramide, potassium dinitramide, potassium perchlorate, and combinations thereof.

14. The method of claim 12, wherein adding at least one inorganic fuel comprises adding at least one member selected from the group consisting of aluminum, magnesium, boron, titanium, silicon, alloys of aluminum, alloys of magnesium, alloys of boron, alloys of titanium, alloys of silicon, and combinations thereof.

15. The method of claim 2, wherein curing the cast propellant formulation with at least one curative comprises curing the cast propellant formulation with at least one member selected from the group consisting of biuret triisocyanate Desmadour curative, hexamethylene diisocyanate, toluene diisocyanate, isophorone diisocyanate and dimer diisocyanate.

16. The method of claim 1, further comprising adding at least one inert liquid to the propellant formulation, the at least one inert liquid selected from the group consisting of triacetin plasticizer, dioctyladipate, isodecyulperlargonate, dioctylphthalate, idioctylmaleate, dibutylphthalate, di-n-propyl adipate, diethylphthalate, dipropylphthalate, n-alkyl citrate, diethyl suberate, diethyl sebacate, diethyl pimelate, and combinations thereof.

17. The method of claim 1, further comprising adding at least one coolant to the propellant formulation, the at least one coolant selected from the group consisting of tetrazotes, triazoles, furazans, oxamide, melamine, hexamine, ammonium oxalate, and ammonium formate.

18. A method of making a rocket motor assembly comprising a rocket motor case, a multi-base rocket motor propellant loaded in the case, and a nozzle in operative association with the rocket motor case to receive and discharge combustion products generated upon ignition of the rocket motor propellant, said method comprising:

diluting nitrocellulose pellets in at least one organic non-solvent to form a slurry;

coating the nitrocellulose pellets with at least one elastomer precursor polymer to form coated nitrocellulose pellets in the slurry, wherein the at least one elastomer precursor polymer is a liquid at room temperature;

removing substantially all of the at least one organic non-solvent from the slurry, wherein the slurry is maintained substantially free of plasticizer prior to removing substantially all of the at least one organic non-solvent therefrom;

subsequent to said removing substantially all of the at least one organic non-solvent from the slurry, mixing the coated nitrocellulose pellets with at least one plasticizer to form a propellant formulation;

casting the propellant formulation in the rocket motor case to form a cast propellant formulation; and providing the nozzle in operative association with the rocket motor case.

19. The method of claim 18, further comprising curing the cast propellant formulation with at least one curative to cure the at least one elastomer precursor polymer into an elastomer, the at least one curative comprising at least one member selected from the group consisting of a diisocyanate and a polyisocyanate.

20. The method of claim 19, wherein diluting nitrocellulose pellets in at least one organic non-solvent to form a slurry comprises diluting nitrocellulose pellets having diameters in a range of from 1 micron to 50 microns.

21. The method of claim 19, wherein diluting nitrocellulose pellets in at least one organic non-solvent to form a slurry comprises diluting nitrocellulose pellets in heptane.

22. The method of claim 19, further comprising maintaining the slurry substantially free of water.

23. The method of claim 19, wherein coating the nitrocellulose pellets with at least one elastomer precursor polymer comprises coating the nitrocellulose pellets with at least one member selected from the group consisting of polycaprolactone, a random copolymer of polyethylene glycol and polypropylene glycol, polyethylene glycol, polypropylene glycol, polyglycoladipate, polyglycidyl nitrate, polypropyleneglycol dinitrate, ethyleneglycol dinitrate, and glycidyl azide polymer.

24. The method of claim 19, wherein mixing the coated nitrocellulose pellets with at least one plasticizer comprises mixing the coated nitrocellulose pellets with at least one member selected from the group consisting of nitroglycerine, trimethylolethanetrinitrate, triethyleneglycoldinitrate, diethyleneglycol-dinitrate, butanetrioltrinitrate, alkyl nitratoethylnitramines, and copolymers and combinations thereof.

25. The method of claim 19, further comprising adding at least one thermal stabilizer to the slurry.

26. The method of claim 25, wherein adding at least one thermal stabilizer comprises adding at least one member selected from the group consisting of N-methyl-p-nitroaniline, ethylcentralite, diphenylamine, 2-nitrodiphenyl amine, N-ethyl-p-nitroaniline, and resorcinol.

27. The method of claim 18, further comprising adding at least one energetic fuel to the propellant formulation to produce a triple-base propellant.

28. The method of claim 27, wherein adding at least one energetic fuel to the propellant formulation comprises adding at least one member selected from the group consisting of nitroguanidine, 4,10-dinitro-2,6,8,12-tetraoxa-4,10-diazatetracyclo-[5.5.0.0$^{5,9}$0$^{3,11}$]-dodecane, 1,3,5-trinitro-1,3,5-triaza-cyclohexane, 1,3,5,7-tetranitro-1,3,5,7-tetraaza-cycloocatane, 2,4,6,8,10,12-hexanitro-2,4,6,8,10,12-hexaazatetracyclo-[5.5.0.0$^{5,9}$0$^{3,11}$]-dodecane, 3-nitro-1,2,4-triazol-5-one, 1,3,5-triamino-2,4,6-trinitrobenzene, 1,1-diamino-2,2-dinitro ethane, ammonium dinitramide, and 1,3,3-trinitroazetidine.

29. The method of claim 18, further comprising adding at least one oxidizer and at least one inorganic fuel to produce a composite-modified multi-base propellant.

30. The method of claim 29, wherein adding at least one oxidizer comprises adding at least one member selected from the group consisting of ammonium perchlorate, ammonium nitrate, hydroxylammonium nitrate, ammonium dinitramide, potassium dinitramide, potassium perchlorate, and combinations thereof.

31. The method of claim 29, wherein adding at least one inorganic fuel comprises adding at least one member selected from the group consisting of aluminum, magnesium, boron, titanium, silicon, alloys of aluminum, alloys of magnesium, alloys of boron, alloys of titanium, alloys of silicon, and combinations thereof.

32. The method of claim 19, wherein curing the cast propellant formulation with at least one curative comprises curing the cast propellant formulation with at least one member selected from the group consisting of biuret triisocyanate Desmadour curative, hexamethylene diisocyanate, toluene diisocyanate, isophorone diisocyanate and dimer diisocyanate.

33. The method of claim 18, further comprising adding at least one inert liquid to the propellant formulation, the at least one inert liquid selected from the group consisting of triacetin plasticizer, dioctyladipate, isodecyulperlargonate, dioctylphthalate, dioctylmaleate, dibutylphthalate, di-n-propyl adipate, diethylphthalate, dipropylphthalate, n-alkyl citrate, diethyl suberate, diethyl sebacate, diethyl pimelate, and combinations thereof.

34. The method of claim 18, further comprising adding at least one coolant to the propellant formulation, the at least one coolant selected from the group consisting of tetrazoles, triazoles, furazans, oxamide, melamine, hexamine, ammonium oxalate, and ammonium formate.

35. A method of making a multi-base rocket motor propellant, comprising:

diluting nitrocellulose pellets in at least one organic non-solvent to form a slurry;

coating the nitrocellulose pellets with at least one non-elastomeric, non-plasticizer to form coated nitrocellulose pellets in the slurry, wherein the at least one non-elastomeric, non-plasticizer is a liquid at room temperature;

removing substantially all of the at least one organic non-solvent from the slurry, wherein the slurry is maintained substantially free of plasticizer prior to removing substantially all of the at least one organic non-solvent therefrom;

subsequent to removing substantially all of the at least one organic non-solvent from the slurry, mixing the coated nitrocellulose pellets with at least one plasticizer to form a propellant formulation; and casting the propellant formulation to form a cast propellant formulation.

36. The method of claim 35, further comprising curing the cast propellant formulation with at least one curative, the at least one curative comprising at least one member selected from the group consisting of a diisocyanate and a polyisocyanate.

37. The method of claim 36, wherein diluting nitrocellulose pellets in at least one organic non-solvent to form a slurry comprises diluting nitrocellulose pellets having diameters in a range of from 1 micron to 50 microns.

38. The method of claim 36, wherein diluting nitrocellulose pellets in at least one organic non-solvent to form a slurry comprises diluting nitrocellulose pellets in heptane.

39. The method of claim 36, further comprising maintaing the slurry substantially free of water.

40. The method of claim 36, wherein coating the nitrocellulose pellets with at least one non-elastomeric, non-plasticizer comprises coating the nitrocellulose pellets with at least one member selected from the group consisting of n-alkyl citrate, diethyl suberate, diethyl sebacate, di-n-propyl adipate, isodecylperlargonate, and combinations thereof.

41. The method of claim 36, wherein mixing the coated nitrocellulose pellets with at least one plasticizer comprises mixing the coated nitrocellulose pellets with at least one member selected from the group consisting of nitroglycerine, trimethylolethanetrinitrate, triethyleneglycoldinitrate, diethyleneglycol-dinitrate, butanetrioltrinitrate, alkyl nitratoethylnitramines, polypropyleneglycol dinitrate, ethyleneglycol dinitrate, and copolymers and combinations thereof.

42. The method of claim 36, further comprising adding at least one thermal stabilizer to the slurry.

43. The method of claim 42, wherein adding at least one thermal stabilizer to the slurry comprises adding at least one member selected from the group consisting of N-methyl-p-nitroaniline, ethylcentralite, diphenylamine, 2-nitrodiphenyl amine, N-ethyl-p-nitroaniline, and resorcinol.

44. The method of claim 35, further comprising adding at least one energetic fuel to the propellant formulation to produce a triple-base propellant.

45. The method of claim 44, wherein adding at least one energetic fuel to the propellant formulation comprises adding at least one member selected from the group consisting of nitroguanidine, 4,10-dinitro-2,6,8,12-tetraoxa-4,10-diazatetracyclo-[5.5.0.0$^{5,9}$0$^{3,11}$]-dodecane, 1,3,5-trinitro-1,3,5-triaza-cyclohexane, 1,3,5,7-tetranitro-1,3,5,7-tetraaza-cycloocatane, 2,4,6,8,10,12-hexanitro-2,4,6,8,10,12-hexaazatetracyclo-[5.5.0.0$^{5,9}$0$^{3,11}$]-dodecane, 3-nitro-1,2,4-triazol-5-one, 1,3,5-triamino-2,4,6-trinitrobenzene, 1,1-diamino-2,2-dinitro ethane, ammonium dinitramide, and 1,3,3-trinitroazetidine.

46. The method of claim 35, further comprising adding at least one oxidizer and at least one inorganic fuel to produce a composite-modified multi-base propellant.

47. The method of claim 46, wherein adding at least one oxidizer comprises adding at least one member selected from the group consisting of ammonium perchlorate, ammonium nitrate, hydroxylammonium nitrate, ammonium dinitramide, potassium dinitramide, potassium perchlorate, and combinations thereof.

48. The method of claim 46, wherein adding at least one inorganic fuel comprises adding at least one member selected from the group consisting of aluminum, magnesium, boron, titanium, silicon, alloys of aluminum, alloys of magnesium, alloys of boron, alloys of titanium, alloys of silicon, and combinations thereof.

49. The method of claim 36, wherein curing the cast propellant formulation with at least one curative comprises curing the cast propellant formulation with at least one member selected from the group consisting of biuret triisocyanate Desmadour curative, hexamethylene diisocyanate, toluene diisocyanate, isophorone diisocyanate and dimer diisocyanate.

50. The method of claim 35, further comprising adding at least one inert liquid to the propellant formulation, the at least one inert liquid selected from the group consisting of triacetin plasticizer, dioctyladipate, isodecyulperlargonate, dioctylphthalate, dioctylmaleate, dibutylphthalate, di-n-propyl adipate, diethylphthalate, dipropylphthalate, n-alkyl citrate, diethyl suberate, diethyl sebacate, diethyl pimelate, and combinations thereof.

51. The method of claim 35, further comprising adding at least one coolant to the propellant formulation, the at least one coolant selected from the group consisting of tetrazoles, triazoles, furazans, oxamide, melamine, hexamine, ammonium oxalate, and ammonium formate.

52. A rocket motor assembly comprising a rocket motor case, a crosslinked multi-base rocket motor propellant loaded in the case, and a nozzle in operative association with the rocket motor case to receive and discharge combustion products generated upon ignition of the crosslinked multi-base rocket motor propellant, said crosslinked multi-base rocket motor propellant comprising:

nitrocellulose;

at least one elastomer, wherein the at least one elastomer is a liquid at room temperature; and at least one plasticizer.

* * * * *